US007383805B2

(12) United States Patent
Michioka et al.

(10) Patent No.: US 7,383,805 B2
(45) Date of Patent: Jun. 10, 2008

(54) CYLINDER LINER FOR INSERT CASTING AND METHOD FOR MANUFACTURING THEREOF

(75) Inventors: Hirofumi Michioka, Aichi (JP); Toshihiro Takami, Toyota (JP); Kazunari Takenaka, Toyota (JP); Takashi Kurauchi, Toyota (JP); Norihiko Tomioka, Toyota (JP); Isao Katou, Okaya (JP); Hiroshi Muraki, Lake City, MO (US); Shunya Hattori, Yamagata (JP); Giichiro Saito, Yamagata (JP); Kiyoharu Oizumi, Sagae (JP)

(73) Assignees: Toyota Jidosha Kabushiki Kaisha, Toyota-shi (JP); Teikoku Piston Ring Co., Ltd., Chiyoda-ku, Tokyo (JP); Teipi Industry Co., Ltd., Sagae-shi (JP)

( * ) Notice: Subject to any disclaimer, the term of this patent is extended or adjusted under 35 U.S.C. 154(b) by 0 days.

(21) Appl. No.: 10/585,583

(22) PCT Filed: Jan. 7, 2005

(86) PCT No.: PCT/JP2005/000441

§ 371 (c)(1),
(2), (4) Date: Dec. 12, 2006

(87) PCT Pub. No.: WO2005/065867

PCT Pub. Date: Jul. 21, 2005

(65) Prior Publication Data

US 2007/0240652 A1 Oct. 18, 2007

(30) Foreign Application Priority Data

Jan. 9, 2004 (JP) ..... 2004-004600

(51) Int. Cl.
*F02F 1/00* (2006.01)

(52) U.S. Cl. ..... 123/193.2; 123/41.84; 92/171.1

(58) Field of Classification Search ..... 123/193.2, 123/41.84, 668; 92/171.1; 29/888.061; 428/600; 164/72
See application file for complete search history.

(56) References Cited

U.S. PATENT DOCUMENTS

| | | | | |
|---|---|---|---|---|
| 7,226,667 | B2 * | 6/2007 | Kodama et al. | 428/600 |
| 2007/0012177 | A1 * | 1/2007 | Miyamoto et al. | 92/171.1 |
| 2007/0012179 | A1 * | 1/2007 | Takami et al. | 92/171.1 |
| 2007/0012180 | A1 * | 1/2007 | Miyamoto et al. | 92/171.1 |
| 2007/0277771 | A1 * | 12/2007 | Holtan et al. | 123/193.2 |

* cited by examiner

*Primary Examiner*—Hieu T. Vo
*Assistant Examiner*—Katrina B. Harris
(74) *Attorney, Agent, or Firm*—Kenyon & Kenyon LLP

(57) ABSTRACT

A cylinder liner for insert casting and a method for manufacturing the cylinder liner are provided. The cylinder liner and the method are applied to cylinder blocks and improve the adherence and the bonding strength with a cylinder block material in a favorable manner. The cylinder liner satisfies the following requirements: (i) the height of projections 1P is in a range between 0.5 mm and 1.0 mm, inclusive; (ii) the number of the projections 1P is in a range between 5 and 60, inclusive, per $cm^2$ on the outer circumferential surface; (iii) the area ratio of regions each encircled by a contour line of a height of 0.4 mm is in a range between 10% and 50%, inclusive; (iv) the area ratio of regions each encircled by a contour line of a height of 0.2 mm is in a range between 20% and 55%, inclusive; (v) the region each encircled by a contour line of the height of 0.4 are independent from each other; and (vi) the area of the regions each encircled by a contour line of the height of 0.4 mm is in a range between 0.2 $mm^2$ and 3.0 $mm^2$, inclusive.

4 Claims, 16 Drawing Sheets

Fig.1 (a)
Fig.1 (b)
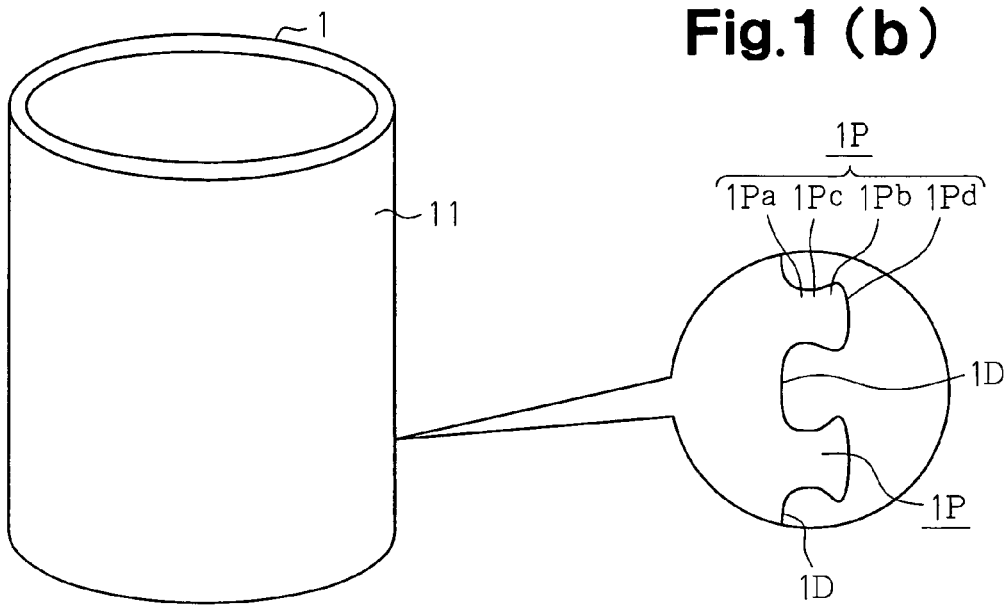
Fig.1 (c)
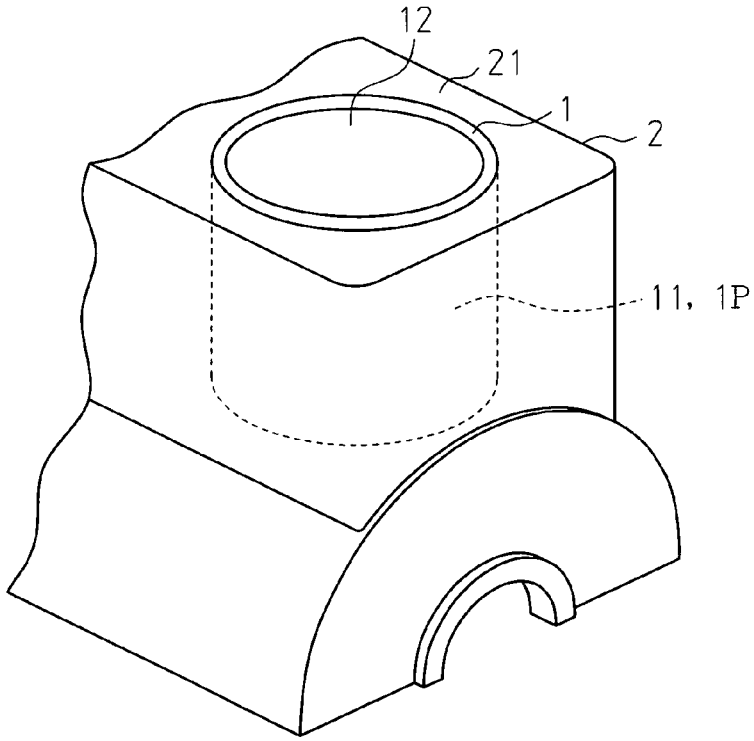

Fig.9

| Conditions for Die-Casting | | |
|---|---|---|
| Aluminum Material | ADC12 | |
| Casting Pressure | 55 | [MPa] |
| Castiong Speed | 1.7 | [m/s] |
| Molten Metal Temperature | 670 | [℃] |
| Cylinder Thickness (Aluminum Material) | 4.0 | [mm] |

CYLINDER LINER FOR INSERT CASTING AND METHOD FOR MANUFACTURING THEREOF

This is a 371 national phase application of PCT/JP2005/000441 filed 7 Jan. 2005 claiming priority to Japanese Application Number 2004-004600 filed 9 Jan. 2004, the contents of which are incorporated herein by reference.

FIELD OF THE INVENTION

The present invention relates to a cylinder liner for insert casting, in which a cylinder liner is cast within another casting material through insert casting and forms an inner cylinder wall of a cylinder structure.

BACKGROUND OF THE INVENTION

Typically, when manufacturing a cylinder block for use in a vehicle engine, a cylinder liner is provided on the inner circumference of each cylinder in a case where parts that slide against a piston need to have improved wear resistance. Cylinder liners are typically applied to cylinder blocks made of an aluminum alloy.

Known methods for manufacturing such cylinder blocks with cylinder liners include a method in which a cylinder liner is placed in a mold for a cylinder block before pouring a casting material into the mold.

Prior art cylinder liners for insert casting include the cylinder liners disclosed in Patent Document 1, Patent Document 2, and Patent Document 3.

[Patent Document 1] Japanese Examined Patent Publication No. 43-4842

[Patent Document 2] Japanese Patent No. 3253605

[Patent Document 3] Japanese Unexamined Patent Publication No. 2003-326353

(a) Patent Document 1 proposes a cylinder liner that has countless minute projections on the outer circumferential surface.

(b) Patent Document 2 proposes a cylinder liner of which the outer circumferential surface is formed to have a predetermined roughness.

(c) Patent Document 3 proposes a cylinder liner that has a number of projections on the outer circumferential surface, in which the projections each have a substantially conical undercut portion flaring outward and a flattened distal end.

SUMMARY OF THE INVENTION

If a material forming a cylinder block (block material) and cylinder liners therefor have insufficient contact, or insufficient adherence, the thermal conductivity of the cylinder block is lowered. This degrades the cooling capacity of the engine.

On the other hand, when the bonding strength between the block material and the cylinder liner is not sufficient, it is difficult to reduce deformation of bores in the cylinder block. This can increase friction.

Accordingly, cylinder liners having improved adherence and bonding strength are desired.

However, the cylinder liners of Patent Documents shown above have the following drawbacks.

(a) In the cylinder liner of Patent Document 1, the projections can be formed on the outer circumferential surface with significantly narrow space between the projections. In this case, molten metal for the block material does not fill the spaces between the projections in a satisfactory manner, which lowers the adherence between the block material and the cylinder liner.

(b) In the cylinder liner of Patent Document 2, since the height of the projections formed on the outer circumferential surface is low, the bonding strength between the cylinder liner and the block material cannot be sufficiently increased.

(c) In the cylinder liner of Patent Document 3, the shape of the projections is not taken into consideration except for the height. That is, the shape of the projections is not optimized. Thus, the adherence and the bonding strength are unlikely to be increased sufficiently.

Accordingly, it is an objective of the present invention to provide a cylinder liner for insert casting and a method for manufacturing the cylinder liner that are applied to cylinder blocks and improve the adherence and the bonding strength with a block material in a favorable manner.

Means for achieving the above objectives and advantages thereof will now be discussed.

A first aspect of the present invention provides a cylinder liner for insert casting, in which the cylinder liner has a plurality of projections with a constriction on an outer circumferential surface and satisfies the following requirements (i) to (iv).

(i) The heights of the projections are in a range between 0.5 mm and 1.0 mm, inclusive.

(ii) The number of the projections on the outer circumferential surface is 5 to 60 per $cm^2$.

(iii) In a contour diagram obtained through measurement of the outer circumferential surface along the height direction of the projections with a three-dimensional laser measuring device, the ratio S1 of area of a region that is encircled by a contour line of a height of 0.4 mm is no less than 10%.

(iv) In a contour diagram obtained through measurement of the outer circumferential surface along the height direction of the projections with a three-dimensional laser measuring device, the ratio S2 of area of a region that is encircled by a contour line of a height of 0.2 mm is no more than 55%.

In a cylinder block having a cylinder liner having a plurality of projections with a constriction on an outer circumferential surface, the constrictions formed on the projections prevent the cylinder liner from falling off the block material (material forming the cylinder block). Therefore, the bonding strength between the block material and the cylinder liner is increased.

The height of a projection refers to the distance from the outer circumferential surface of the cylinder liner to the distal end of the projection with reference to the outer circumferential surface.

A contour line of a height of 0.4 mm or 0.2 mm refers to a contour line that is spaced from the outer circumferential surface of the cylinder liner by 0.4 mm or 0.2 mm along the height direction of the projection (radially outward direction of the cylinder liner).

In a first aspect of the present invention, the area ratio S1 and the area ratio S2 satisfy the inequality S1<S2 .

The region encircled by the contour line of the height of 0.4 mm refers to a cross-section of one of projections that is contained in a plane spaced from the outer circumferential surface by 0.4 mm. The region encircled by the contour line of the height of 0.2 mm refers to a cross-section of one of projections that is contained in a plane spaced from the outer circumferential surface by 0.2 mm.

Hereinafter, drawbacks of a cylinder liner that does not satisfy the requirements of the first aspect of the present invention will be discussed with respect to the height of projections, the number of projections, the area ratio S1 of projections, and the area ratio S2 of projections.

[1] Regarding the Height of Projections

In a case where a cylinder liner is formed with projections of which the height is less than 0.5 mm, the formability of the projections is lowered. Thus, the number of the projections on the produced cylinder liner is insufficient. Accordingly, a cylinder block in which the cylinder liner is provided through insert casting will not have sufficient bonding strength between the block material and the cylinder liner.

In a case where the height of projections is no less than 1.0 mm, the formed projections are easily broken. This results in uneven heights of the projections and degrades the accuracy of the outer diameter. Also, since projections having constrictions are easily broken, the advantage of preventing the cylinder liner from falling off the block material is reduced.

[2] Regarding the Number of Projections

A cylinder liner that has less than five projections per $cm^2$ will not have sufficient bonding strength between the block material and the cylinder liner due to an insufficient number of projections.

In a case of a cylinder liner having more than sixty projections per $cm^2$, since the space between the projections is narrow, molten metal for the block material is not sufficiently supplied to the spaces between the projections. This creates gaps between the block material and the cylinder liner, which lowers the adherence.

[3] Regarding Area Ratio S1

In a case of a cylinder block having a cylinder liner of which the area ratio S1 is less than 10%, the bonding strength between the block material and the liner is significantly lower compared to a cylinder block having a cylinder liner of which the area ratio S1 is more than 10%.

[4] Regarding Area Ratio S2

In a case of a cylinder block having a cylinder liner of which the area ratio S2 is more than 55%, the adherence between the block material and the liner is significantly lower compared to a cylinder block having a cylinder liner of which the area ratio S2 is no more than 55%.

A cylinder liner according to the first aspect eliminates the drawbacks [1] to [4]. Therefore, the adherence and the bonding strength of the cylinder liner and the block material are improved in a favorable manner.

In a second aspect, the present invention provides a cylinder liner for insert casting, in which the cylinder liner has a plurality of projections each with a constriction on an outer circumferential surface and satisfies the following requirements (i) to (iv).

(i) The height of the projections is in a range between 0.5 mm and 1.0 mm, inclusive.

(ii) The number of the projections on the outer circumferential surface is 5 to 60 per $cm^2$.

(iii) In a contour diagram obtained through measurement of the outer circumferential surface along the height direction of the projections with a three-dimensional laser measuring device, the ratio S1 of area of a region that is encircled by a contour line of the height of 0.4 mm is in a range between 10% and 50%, inclusive.

(iv) In a contour diagram obtained through measurement of the outer circumferential surface along the height direction of the projections with a three-dimensional laser measuring device, the ratio S2 of area of a region that is encircled by a contour line of the height of 0.2 mm is in a range between 20% and 55%, inclusive.

This configuration has the following advantages in addition to the advantages of the first aspect of the present invention. Since the upper limit of the area ratio S1 is set to 50%, the area ratio S2 is prevented from being more than 55%. Since the lower limit of the area ratio S2 is set to 20%, the area ratio S1 is prevented from being less than 10%.

In a cylinder liner in accordance with the first and second aspects, it is preferable that the following requirements (vi) and (vii) be satisfied. (vi) Regions each encircled by a contour line of the height of 0.4 mm are independent from each other in the contour diagram. (vii) The area of regions each encircled by the contour line of the height of 0.4 mm is in a range between 0.2 $mm^2$ and 3.0 $mm^2$, inclusive.

The area of a region encircled by the contour line of the height of 0.4 mm corresponds to a cross-sectional area of each projection that is contained in a plane spaced from the outer circumferential surface by 0.4 mm.

Hereinafter, drawbacks of a cylinder liner that does not satisfy the requirements (vi), (vii) will be discussed with respect to the shape of the projections and the area of each projection.

[5] Regarding the Shape of Projections

If regions each encircled by a contour line of the height of 0.4 mm interfere with each other, that is, if projections are connected to each other at the height of 0.4 mm from the outer circumferential surface, molten metal is not sufficiently supplied to the spaces between the projections when molten metal for the block material is poured into the molding. This creates gaps between the block material and the cylinder liner, which lowers the adherence.

[6] Regarding the Area of Each Projection

If the area of each projection is less than 0.2 $mm^2$, the projections have decreased strength. Therefore, when a cylinder liner having such projections is produced, the projections are damaged.

If the area of regions each encircled by a contour line of the height of 0.4 mm is more than 3.0 $mm^2$, molten metal is not sufficiently supplied to the spaces between the projections when molten metal for the block material is poured into the molding. This creates gaps between the block material and the cylinder liner, which lowers the adherence.

Since a cylinder liner satisfying the requirements (vi) and (vii) eliminates the above described drawbacks, the adherence and the bonding strength of the cylinder liner and the block material are further improved.

In a third aspect, the present invention provides a method for manufacturing a cylinder liner for insert casting, in which the method uses centrifugal casting. According to the manufacturing method, a suspension is prepared which contains 8 to 30% by mass of refractory material, 2 to 10% by mass of binder, and 60 to 90% by mass of water. A surfactant of which the loading is greater than 0.005% by mass and no more than 0.1% by mass is added to the suspension to form mold wash. The mold wash is applied to an inner circumferential surface of a mold that has been heated and is being rotated, thereby forming a mold wash layer. A recess is formed through action of the surfactant on each of bubbles in the mold wash layer. The bottom of each recess reaches the inner circumferential surface of the mold, so that a recess with a constriction is formed in the mold wash layer. Thereafter, molten metal of cast iron is poured into the mold in which the mold wash has been dried. Consequently, a cylinder liner is manufactured that has projections each having a constriction, in which projections are formed on the outer circumferential surface.

Functions of the mold wash, the refractory material, the binder, water, and the surfactant in the manufacturing process of the cylinder liner will now be described.

The mold wash functions as a refractory material or a mold release agent that generally prevents molten metal from seizing or being welded to the mold, and as a heat insulator that controls the cooling speed of the molten material to obtain an appropriate material.

The refractory material is a base material of the mold wash.

The binder couples the base materials to increase the strength of the mold wash.

Water adjusts the viscosity of the suspension (liquid in which the refractory material, the binder, and water are mixed) and allows the mold wash to be uniformly applied to the inner circumferential surface of the mold.

The surfactant acts on bubbles in the mold wash layer (the layer of mold wash applied to the inner circumferential surface of the mold), to form recesses each with a constriction in the mold wash layer.

Hereinafter, drawbacks of a manufacturing method for a cylinder liner that does not satisfy the requirements of the third aspect of the present invention will be discussed with respect to the loading of the refractory material, the loading of the binder, the loading of water, and the loading of the surfactant.

[A] Loading of Refractory Material

In a manufacturing method in which the loading of refractory material is less than 8% by mass, the effects of exfoliation and heat insulation are reduced. This causes molten metal to be welded to the mold and degrades the material of the cylinder liner.

In a manufacturing method in which the loading of refractory material is more than 30% by mass, the fluidity of the mold wash is lowered. Thus, it is difficult to uniformly apply the mold wash to the inner circumferential surface of the mold. As a result, the heights of the projections on the cylinder liner become uneven. This degrades the outer diameter accuracy of the cylinder liner.

[B] Loading of Binder

In a manufacturing method in which the loading of the binder is less than 2% by mass, the strength of the mold wash is not sufficient. This lowers the formability of the projections.

In a manufacturing method in which the loading of the binder is more than 10% by mass, the fluidity of the mold wash is lowered. Thus, it is difficult to uniformly apply the mold wash to the inner circumferential surface of the mold. As a result, the heights of the projections on the cylinder liner become uneven. This degrades the outer diameter accuracy of the cylinder liner.

[C] Loading of Water

In a manufacturing method in which the loading of water is less than 60% by mass, the fluidity of the mold wash is lowered. Thus, it is difficult to uniformly apply the mold wash to the inner circumferential surface of the mold. As a result, the heights of the projections on the cylinder liner become uneven. This degrades the outer diameter accuracy of the cylinder liner.

In a manufacturing method in which the loading of water is more than 90% by mass, the mold wash layer resists being dried. This lowers the formability of the projections.

[D] Loading of Surfactant

In a method in which the loading of the surfactant is no more than 0.005% by mass, the action of the surfactant is significantly small. Thus, it is difficult to form projections on the outer circumferential surface of the cylinder liner.

In a method in which the loading of the surfactant is more than 0.1% by mass, the action of the surfactant in the mold is excessive. Thus, it is difficult to form projections with constrictions on the outer circumferential surface of the cylinder liner.

The method for manufacturing a cylinder liner according to the third aspect eliminates the drawbacks [A] to [D]. Therefore, a cylinder liner having improved adherence and bonding strength with the block material is manufactured.

In a fourth aspect, the present invention provides a method for manufacturing a cylinder liner for insert casting, in which the method uses centrifugal casting. In this manufacturing method, a cylinder liner for insert casting is manufactured through the following steps (a) to (d).

(a) A step for preparing a suspension that contains 8 to 30% by mass of refractory material, 2 to 10% by mass of binder, and 60 to 90% by mass of water.

(b) A step for forming mold wash by adding to the suspension a surfactant of which the loading is greater than 0.005% by mass and no more than 0.1% by mass.

(c) A step for applying the mold wash to an inner circumferential surface of a mold that has been heated to a predetermined temperature and is being rotated, thereby forming a mold wash layer.

(d) A step for pouring molten metal of cast iron into the mold after the mold wash has been dried and while the mold is being rotated, thereby manufacturing a cylinder liner that has a plurality of projections each having a constriction on the outer circumferential surface.

Like the manufacturing method of the third aspect, the method for manufacturing a cylinder liner according to the fourth aspect also manufactures a cylinder liner having improved adherence and bonding strength with the block material.

In a fifth aspect, the present invention provides a method for manufacturing a cylinder liner for insert casting, in which the method uses centrifugal casting. In this manufacturing method, a cylinder liner for insert casting is manufactured through the following steps (a) to (e).

(a) A step for preparing a suspension that contains 8 to 30% by mass of refractory material, 2 to 10% by mass of binder, and 60 to 90% by mass of water.

(b) A step for forming mold wash by adding to the suspension a surfactant of which the loading is greater than 0.005% by mass and no more than 0.1% by mass.

(c) A step for applying the mold wash to an inner circumferential surface of a mold that has been heated to a predetermined temperature and is being rotated, thereby forming a mold wash layer.

(d) A step in which recesses are formed through action of the surfactant on bubbles in the mold wash layer, and the bottom of each recess reaches the inner circumferential surface of the mold, so that a recess with a constriction is formed in the mold wash layer.

(e) A step for pouring molten metal of cast iron into the mold after the mold wash has been dried and while the mold is being rotated, thereby manufacturing a cylinder liner that has projections each having a constriction on the outer circumferential surface.

Like the manufacturing method of the fourth aspect, the method for manufacturing a cylinder liner according to the fifth aspect also manufactures a cylinder liner having improved adherence and bonding strength with the block material.

In the method for manufacturing a cylinder liner for insert casting according to any one of third to fifth aspects, the average particle size of the refractory material is preferably in a range between 0.02 mm and 0.1 mm, inclusive.

In a manufacturing method in which the average particle size of the refractory material is less than 0.02 mm, the refractory material becomes insoluble to water, which lowers the work efficiency.

In a manufacturing method in which the average particle size of the refractory material is more than 0.1 mm, the inner circumferential surface of the mold wash layer becomes rough after the mold wash is applied to the inner circumferential surface of the mold. Thus, it is difficult to smooth the outer circumferential surface of the cylinder liner. This lowers the filling factor for molten metal between the projections on the cylinder liner. Accordingly, the adherence between the block material and the cylinder liner is decreased.

However, in a method for manufacturing a cylinder liner in which the average particle size of the refractory material is set within the above preferable range, the drawbacks are eliminated. That is, a smooth outer circumferential surface is formed between the projections on the cylinder liner, while improving the working efficiency for manufacturing the cylinder liner.

Further, in the manufacturing methods described above, the thickness of the mold wash layer is preferably in a range between 0.5 mm and 1.1 mm, inclusive.

In this case, the height of the projections is reliably set within the range between 0.5 mm and 1.0 mm, inclusive.

BRIEF DESCRIPTION OF THE DRAWINGS

FIG. 1(*a*) is a perspective view illustrating the structure of a cylinder liner for insert casting according to one embodiment of the present invention;

FIG. 1(*b*) is an enlarged cross-sectional view illustrating a part of the cylinder liner;

FIG. 1(*c*) is a perspective view illustrating a cylinder block in which the cylinder liner of the embodiment of FIG. 1(*a*) is used;

FIG. 9 is a chart showing requirements for performing die-casting;

DETAILED DESCRIPTION OF THE PREFERRED EMBODIMENTS

Figure 2:
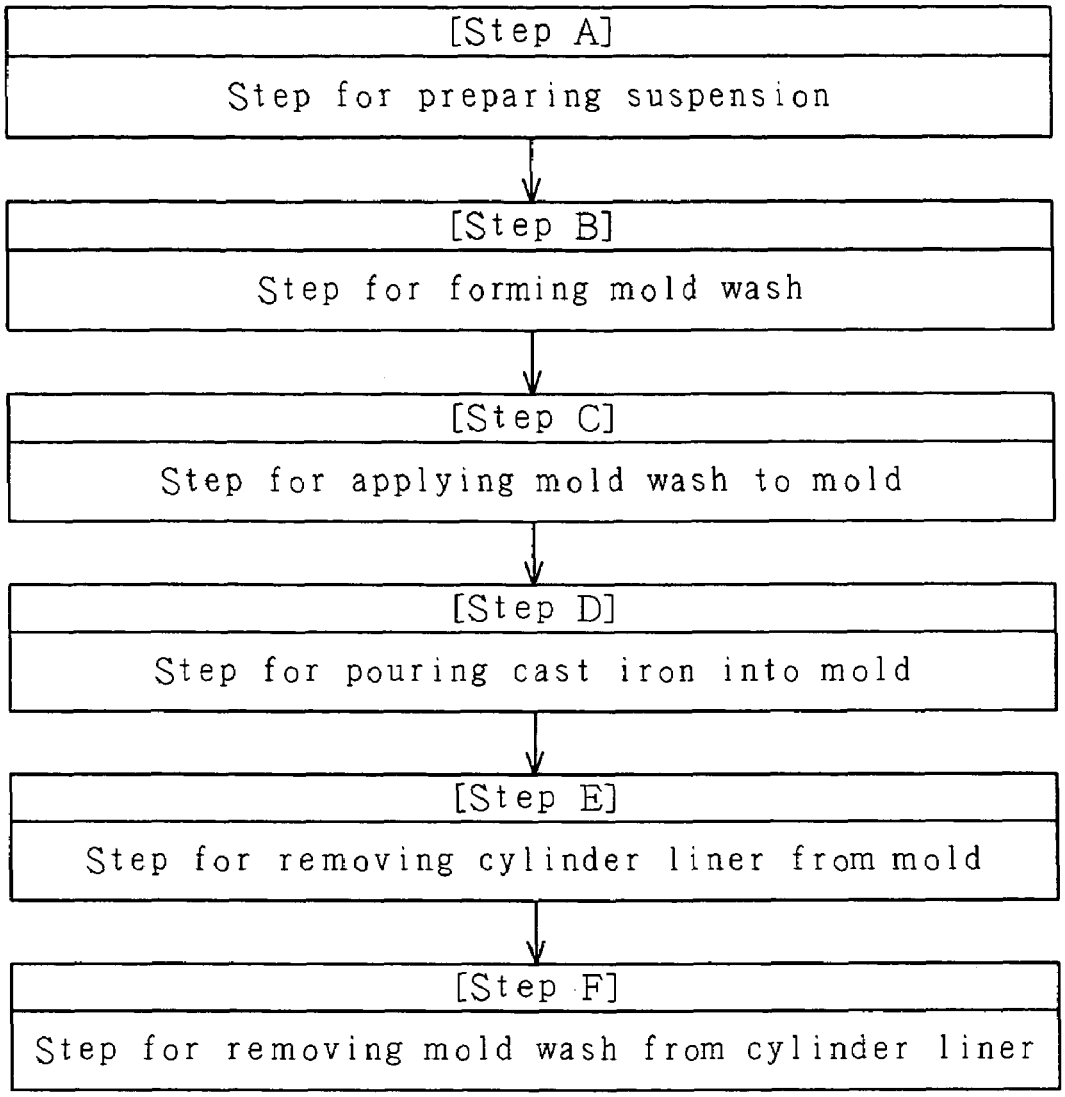
FIG. 2 is a flowchart showing steps for manufacturing a cylinder liner.

One embodiment of the present invention will now be described with reference to FIGS. 1(*a*) to 4. FIGS. 1(*a*) and 1(*b*) illustrate a cylinder liner 1 for insert casting according to the present invention. FIG. 1(*c*) illustrates a part of a cylinder block 2 in which the cylinder liner 1 is used.

Taking reduction of weight and costs into consideration, an aluminum material (aluminum or an aluminum alloy) may be used as the material for the cylinder block 2. As the aluminum alloy, for example, an alloy specified in Japanese Industrial Standard (JIS) ADC10 (related United States standard, ASTM A380.0) or an alloy specified in JIS ADC12 (related United States standard, ASTM A383.0) may be used.

Projections 1P, each having a constricted shape, are formed on the outer circumferential surface of a cylinder liner 1, that is, on an liner outer circumferential surface 11.

Each projection 1P is formed to have the following property.

Each projection 1P has the narrowest section, or a constriction 1Pc, in an intermediate portion between a proximal portion 1Pa and a distal portion 1Pb.

Each projection 1P is flared from the constriction 1Pc toward the proximal portion 1Pa and toward the distal portion 1Pb.

Each projection 1P has a substantially flat top surface 1Pd at the distal portion 1Pb. The top surface 1Pd is located at the outermost position with respect to the radial direction of the cylinder liner 1.

A substantially flat surface (base surface 1D) is formed between the projections 1P. The base surface 1D substantially corresponds to the liner outer circumferential surface 11.

The cylinder block 2 has the cylinder liner 1 located on the inner circumference of a cylinder 21.

The material forming the cylinder block 2 (an aluminum material in this embodiment) and the cylinder liner 1 are coupled to each other through the liner outer circumferential surface 11 and the outer circumferential surface of each projection 1P.

The inner circumferential surface of the cylinder liner 1 (the liner inner circumferential surface 12) forms the inner wall of the cylinder 21 in the cylinder block 2.

<Manufacturing Process for Cylinder Liner>

FIG. 2 schematically shows the manufacturing process for the cylinder liner 1.

The cylinder liner 1 is manufactured through Step A to Step F as shown in FIG. 2.

Figure 3:
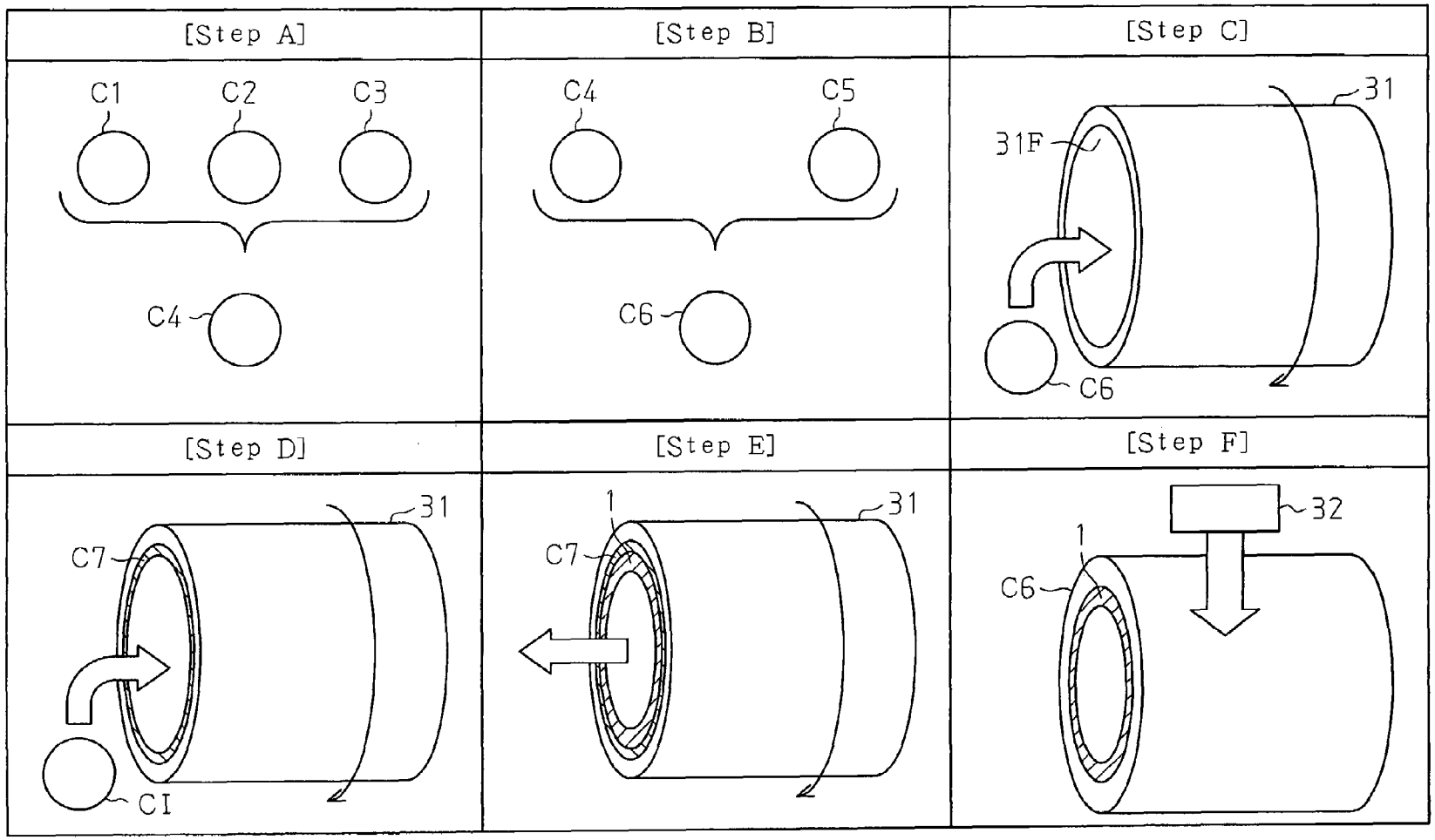
FIG. 3 is a process diagram showing steps for manufacturing a cylinder liner.

Each step will be described with reference to FIG. 3.

[Step A]

Suspension C4 is prepared by compounding refractory material C1, binder C2, and water C3 in predetermined ratios.

In this embodiment, possible ranges for the loadings of the refractory material C1, the binder C2, and water C3 and possible ranges for the average particle size of the refractory material C1 are set as follows.

Loading of the refractory material C1: 8 to 30% by mass

Loading of the binder C2: 2 to 10% by mass

Loading of water C3: 60 to 90% by mass

Average particle size of the refractory material C1: 0.02 to 0.1 mm

[Step B]

A predetermined amount of surfactant C5 is added to the suspension C4 to obtain mold wash C6.

In this embodiment, a possible range of the loading of the surfactant C5 is set as follows.

Loading of the surfactant C5: 0.005% by mass<X≦0.1% by mass (X represents the loading)

[Step C]

The mold wash C6 is applied through spraying on an inner circumferential surface 31F of a mold 31, which has been heated to a specific temperature and is being rotated. At this time, the mold wash C6 is applied such that a layer of the mold wash C6 (mold was layer C7) of a uniform thickness is formed on the entire inner circumferential surface 31F.

In this embodiment, a possible range for the thickness of the mold wash layer C7 is set as follows.

Thickness of the mold wash layer C7: 0.5 mm to 1.0 mm

Figure 4:
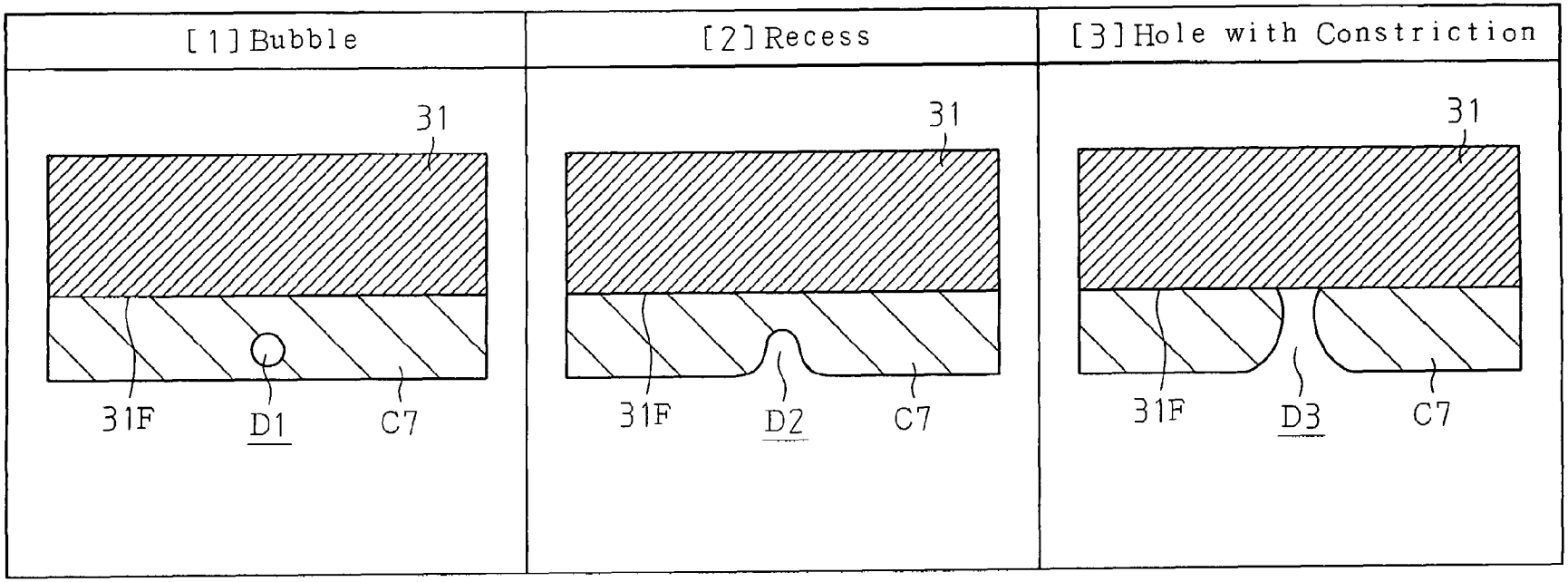
FIG. 4 is a series of cross-sectional views showing steps through which a mold wash layer is formed in a manufacturing step for a cylinder liner.

FIG. 4 shows the order of steps for forming a hole with a constriction in the mold wash layer C7.

As shown in FIG. 4, the surfactant C5 acts on a bubble D1 in the mold wash layer C7, so that a recess D2 is formed in the inner circumference of the mold wash layer C7. Then, the bottom of the recess D2 reaches the inner circumferential surface 31F of the mold 31, so that a recess (or a hole) D3 having a constriction is formed in the mold wash layer C7. The recess D3 extends through the mold wash layer C7.

[Step D]

After the mold wash layer C7 is dried, molten metal CI of cast iron is poured into the mold 31, which is being rotated. At this time, projections each having a shape that corresponds to the shape of the recess D3 of the mold wash layer C7 are transferred onto the cylinder liner 1 so that the projections 1P each having a constriction are formed on the outer circumferential surface of the cylinder liner 1.

[Step E]

After the molten metal CI is hardened and the cylinder liner 1 is formed, the cylinder liner 1 is taken out of the mold 31 with the mold wash layer C7.

[Step F]

Using a blasting device 32, the mold wash C6 is removed from the outer circumferential surface of the cylinder liner 1.

<Area Ratio of Projections>

In this embodiment, possible ranges for a first projection area ratio S1 and a second projection area ratio S2 of the cylinder liner 1 are set as follows.

First projection area ratio S1: no less than 10%

Second projection area ratio S2: no more than 55%

Alternatively, the following settings may be applied.

First projection area ratio S1: 10%-50%

Second projection area ratio S2: 20%-55%

The first projection area ratio S1 corresponds to the cross-sectional area of the projections 1P per unit area in a plane the height of which is spaced from the base surface 1D by 0.4 mm (the distance in the height direction with reference to the base surface 1D).

The second projection area ratio S2 corresponds to the cross-sectional area of the projections 1P per unit area in a plane the height of which is spaced from the base surface 1D by 0.2 mm (the distance in the height direction with reference to the base surface 1D).

<Composition of Cast Iron>

Taking the wear resistance, the seizure resistance, and the formability into consideration, the composition of the iron cast, which is the material for the cylinder liner 1, is preferably set as follows.

T.C: 2.9% by mass—3.7% by mass

Si: 1.6% by mass—2.8% by mass

Mn: 0.5% by mass—1.0% by mass

P: 0.05% by mass—0.4% by mass

T.C. means total carbon included in the material.

The following substances may be added as necessary.

Cr: 0.05% by mass—0.4% by mass

B: 0.03% by mass—0.08% by mass

Cu: 0.3% by mass—0.5% by mass

The remainder of the composition, that is, the value obtained by subtracting the total amount of the listed substances from 100% by mass, consists of iron.

EXAMPLES

Hereinafter, the present invention will be described based on comparison between examples and comparison examples.

In the examples and the comparison examples, cylinder liners were produced through centrifugal casting using a material equivalent to FC230 (gray iron, the tensile strength is 230 MPa). The thickness of each cylinder liner when completed was set to 2.3 mm. Each set of conditions listed below was unique to one of the examples and the comparison examples. Other conditions were common to all of the examples and the comparison examples.

In the examples and the comparison examples, cylinder liners were produced generally according to the manufacturing method of the embodiment. However, the order of steps for forming the recess in [Step C] and the shape of the projection in [Step D] were varied between the examples and the comparison examples.

Examples 1 to 4

Diatom earth was used as the refractory material, and bentonite was used as the binder.

Diatom earth, bentonite, water, and surfactant were mixed in the proportions shown in Table 1 to obtain mold wash.

The mold wash was sprayed onto the inner circumferential surface of a mold, which had been heated to 200° C. to 400° C. to form a mold wash layer on the inner circumferential surface.

[Table 1]

TABLE 1

| | Diatom Earth [% by mass] | Bentonite [% by mass] | Surfactant [% by mass] | Water [% by mass] |
|---|---|---|---|---|
| Example 1 | 24 | 6 | 0.008 | remainder |
| Example 2 | 20 | 6 | 0.01 | remainder |
| Example 3 | 20 | 5.5 | 0.011 | remainder |
| Example 4 | 16 | 4 | 0.013 | remainder |

*remainder: 100 − (refractory material + binder + surfactant) [% by mass]

Comparison examples 1, 2

Diatom earth was used as the refractory material, and bentonite was used as the binder.

Diatom earth, bentonite, water, and surfactant were mixed in the proportions shown in Table 2 to obtain mold wash.

The mold wash was sprayed onto the inner circumferential surface of a mold, which had been heated to 200° C. to 400° C. to form a mold wash layer on the inner circumferential surface.

TABLE 2

| | Diatom Earth [% by mass] | Quartz Sand [% by mass] | Silica Flour [% by mass] | Bentonite [% by mass] | Surfactant [% by mass] | Water [% by mass] |
|---|---|---|---|---|---|---|
| Comparison Example 1 | 25 | — | — | 8 | 0.003 | remainder |
| Comparison Example 2 | 20 | — | — | 5.5 | 0.15 | remainder |
| Comparison Example 3 | — | 34 | 17 | 4 | — | remainder |
| Comparison Example 4 | — | 34 | 17 | 4 | 0.02 | remainder |

* remainder: 100 − (refractory material + binder + surfactant) [% by mass]

Comparison Example 3

Diatom earth and silica flour were used as the refractory material, and bentonite was used as the binder.

Quartz sand, silica flour, bentonite, water, and surfactant were mixed in the proportions shown in Table 2 to obtain mold wash.

The mold wash was sprayed onto the inner circumferential surface of a mold, which had been heated to approximately 300° C. to form a mold wash layer on the inner circumferential surface.

Comparison Example 4

Diatom earth and silica flour were used as the refractory material, and bentonite was used as the binder.

Quartz sand, silica flour, bentonite, water, and surfactant were mixed in the proportions shown in Table 2 to obtain mold wash.

The mold wash was sprayed onto the inner circumferential surface of a mold, which had been heated to approximately 300° C. to form a mold wash layer on the inner circumferential surface.

The following measurements [a] to [h] were taken for Examples 1 to 4 and Comparison Examples 1 to 4.

[a] First projection area ratio S1

[b] Second projection area ratio S2

[c] First projection cross-sectional area SD1

[d] Number of projections N1

[e] Bonding Strength P

[f] Voidage G

[g] Degree of constriction PR

[h] Projection Height H

Contour lines obtained through measurements on the outer circumferential surface of the cylinder liners will now be described.

<Contour Lines of Projections>

Figure 5:
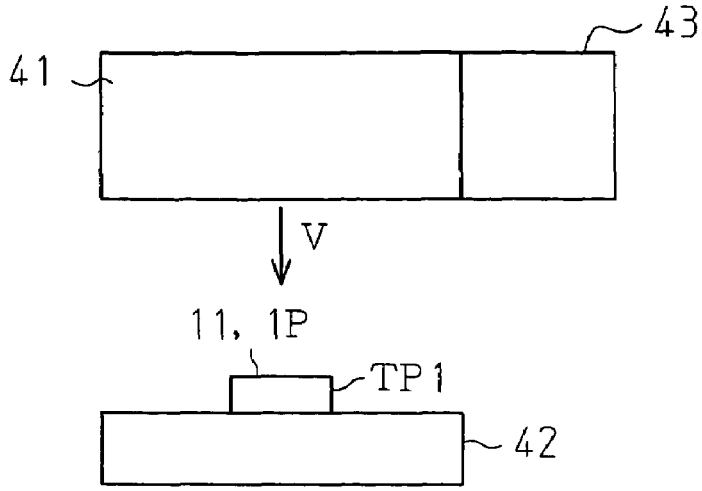
FIGS. 5(*a*) and 5(*b*) are diagrams showing measurement of contour lines of a projection.
Figure 5:
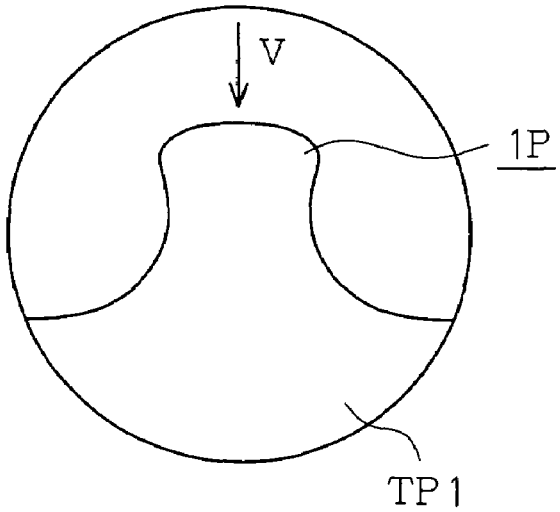

Referring to FIGS. 5(*a*) and 5(*b*), the measurements of contour lines for projections will be explained.

[1] A test piece TP1 for contour line measurement was set on a test bench 42 such that the liner outer circumferential surface 11 (projections 1P) faces a noncontact three-dimensional laser measuring device 41.

[2] Laser light was irradiated from the three-dimensional laser measuring device 41 to the test piece TP1. At this time, the laser light was irradiated such that the light was substantially perpendicular to the liner outer circumferential surface 11 (along an arrow V in the drawing).

[3] The measurement results of the three-dimensional laser measuring device 41 were imported into an image processing device 43 to show a contour diagram of the projection 1P.

Figure 6:
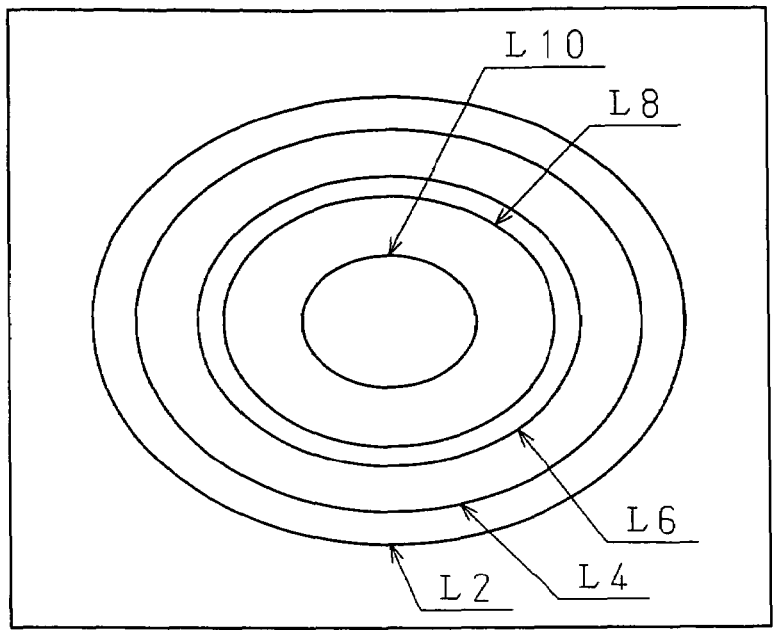
FIGS. 6(*a*) and 6(*b*) are diagrams showing contour lines of a projection.
Figure 6:
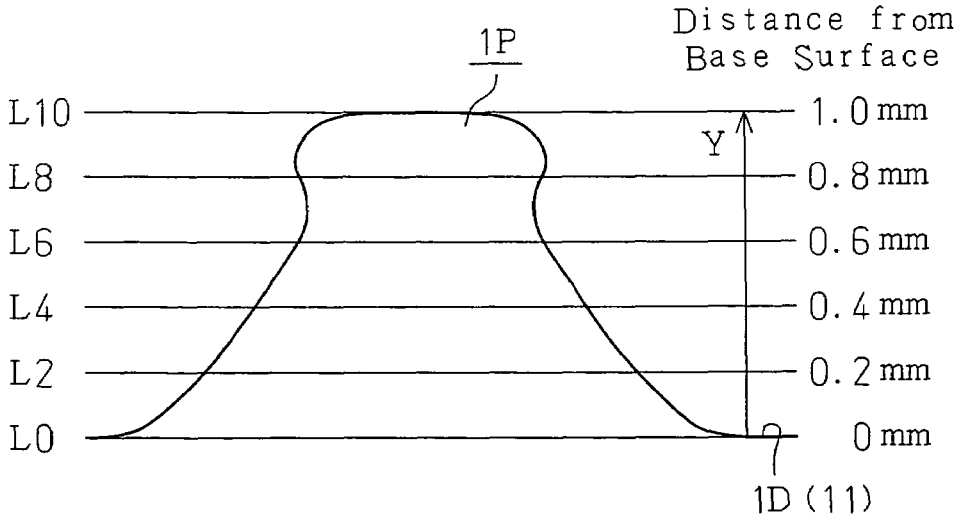

FIG. 6(*a*) shows an example of a contour diagram.

FIG. 6(*b*) shows the relationship between contour lines L and the base surface 1D of the cylinder liner 1 (the liner outer circumferential surface 11).

As shown in FIG. 6(*b*), the contour lines L are shown on the contour line diagram at a predetermined interval from the base surface 1D (the liner outer circumferential surface 11) along the height direction of the projection 1P (along an arrow Y). Hereinafter, the distance along the arrow Y with reference to the base surface 1D will be referred to as measurement height.

Although FIG. 6 shows a diagram in which the contour lines L are shown at a 0.2 mm interval, the distance between the contour lines L may be changed as necessary.

[a] First Projection Area Ratio

Figure 7:
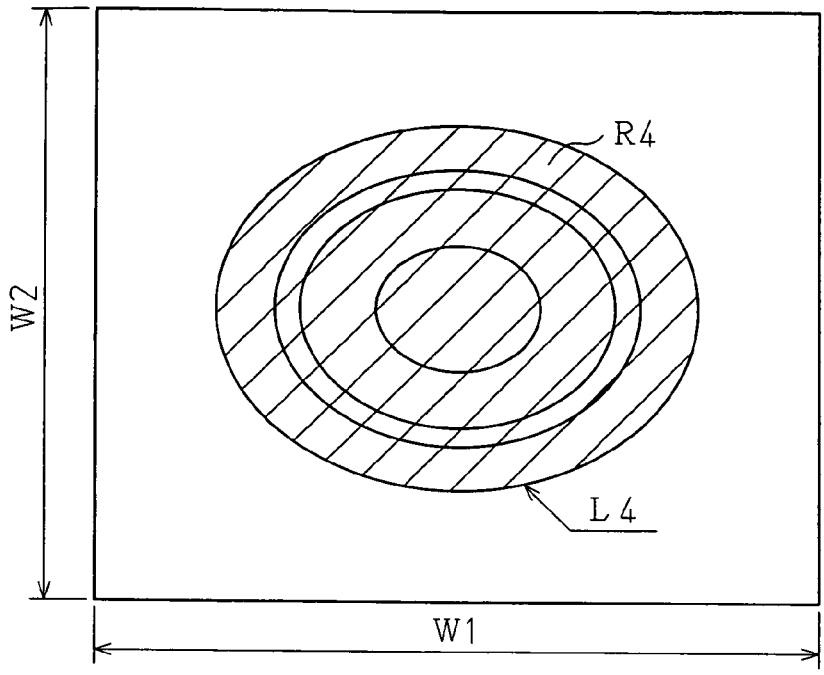
FIGS. 7(*a*) and 7(*b*) are diagrams showing contour lines of a projection.
Figure 7:
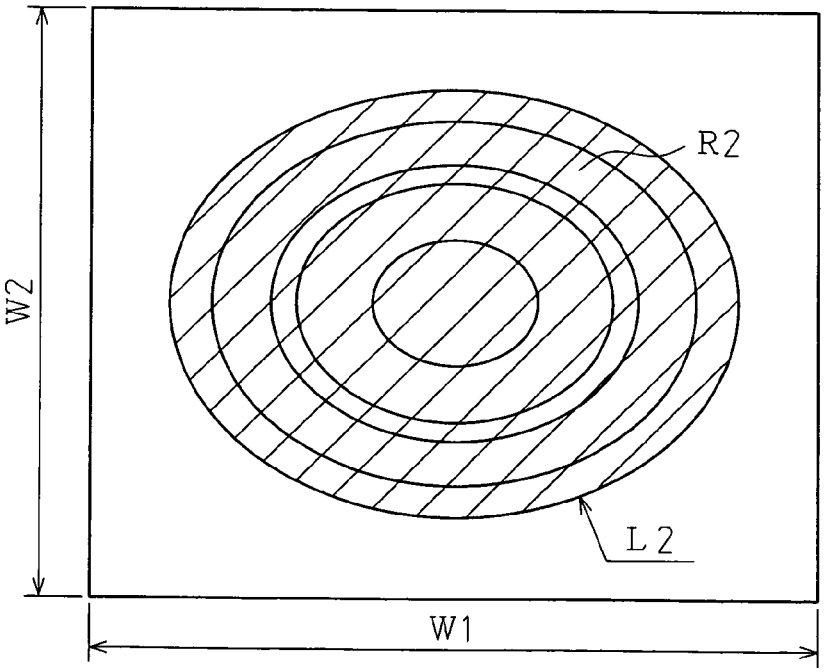

FIG. 7(*a*) is a contour diagram in which contour lines less than 0.4 mm of measurement height are not shown (first contour diagram F1). The area of the contour diagram as shown (W1×W2) is a unit area for measuring the first projection area ratio S1 .

In the first contour diagram F1, the area of a region R4 surrounded by the contour line L4 (the area of cross-hatched section SR4 in the drawing) corresponds to the cross-sectional area of a projection that lies in the plane of height of 0.4 mm (the first projection cross-sectional area SD1). The number of the regions R4 in the first contour diagram F1 (the number of regions N4) corresponds to the number of the projections 1P in the first contour diagram F1.

The first projection area ratio S1 is calculated as the ratio of the total area of the regions R4 (SR4×N4) to the area of the contour diagram (W1×W2). That is, the first projection area ratio S1 corresponds to the total area of the first projection cross-sectional area SD1 in the unit area in the plane of the measurement height of 0.4 mm.

The first projection area ratio S1 is computed by the following equation.

$$S1=(SR4\times N4)/(W1\times W2)\times 100[\%]$$

[b] Second Projection Area Ratio

FIG. 7(*b*) is a contour diagram in which contour lines less than 0.2 mm of measurement height are not shown (second contour diagram F2). The area of the contour diagram (W1×W2) is a unit area for measuring the second projection area ratio S2 .

In the second contour diagram F2, the area of a region R2 surrounded by the contour line L2 (the area of cross-hatched section SR2 in the drawing) corresponds to the cross-sectional area of a projection that lies in the plane of height of 0.2 mm (the second projection cross-sectional area SD2). The number of the regions R2 in the second contour diagram F2 (the number of regions N2) corresponds to the number of the projections 1P in the second contour diagram F2.

The second projection area ratio S2 is calculated as the ratio of the total area of the regions R2 (SR2×N2) to the area of the contour diagram (W1×W2). That is, the second projection area ratio S2 corresponds to the total area of the second projection cross-sectional area SD2 in the unit area in the plane of the measurement height of 0.2 mm.

The second projection area ratio S2 is computed by the following equation.

$$S2=(SR2\times N2)/(W1\times W2)\times 100[\%]$$

[c] First Projection Cross-Sectional Area

The first projection cross-sectional area SD1 is calculated as a cross-sectional area of one of the projections that lies in a plane of the measurement height of 0.4 mm. For example, through image processing of the contour diagrams, the first projection cross-sectional area SD1 is obtained by calculating the area of the region R4 in the first contour diagram F1 (FIG. 7(*a*)), or the cross-sectional area SR4 of the cross-hatched section.

[d] Number of Projections

The number of projections N1 is calculated as the number of the projections 1P formed per unit area (1 $cm^2$) on the outer circumferential surface 11 of the cylinder liner 1 from the contour diagrams. For example, through image processing of the contour diagrams, the number of projections N1 is obtained by calculating the number of the regions R4 in the first contour diagram F1 (FIG. 7(*a*)).

[e] Bonding Strength

Figure 8:
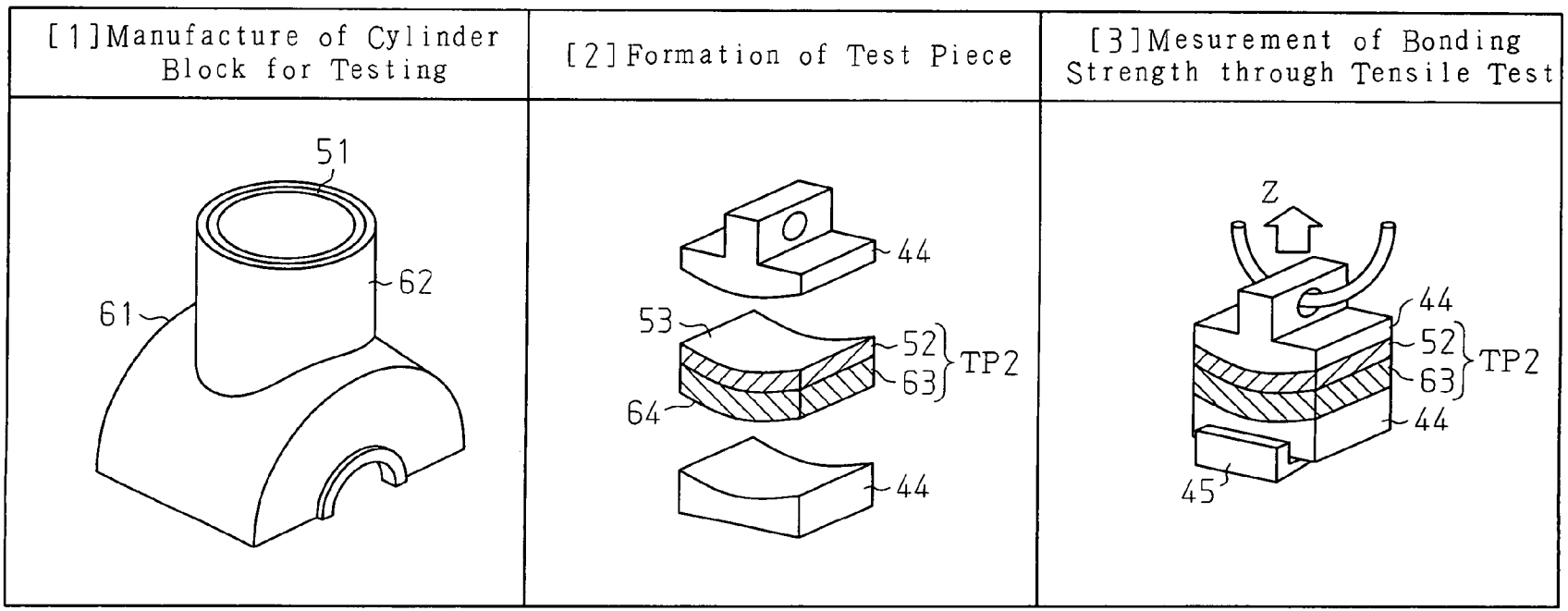
FIG. 8 is a diagram showing measurement of bonding strength.

FIG. 8 shows the measurement of the bonding strength P.

[1] Single cylinder type cylinder blocks 61 for evaluation were produced through die casting. The examples 1 to 4 and the comparison examples 1 to 4 were applied to the cylinder liners 51 for the cylinder blocks 61. The die casting was performed with the conditions shown in FIG. 9.

[2] From a cylinder 62 of each single cylinder type cylinder block 61, a test piece TP2 having a liner wall 52 and a cylinder wall 63 was produced. Arms 44 for a tensile test were bonded to the liner inner circumferential surface 53 and the cylinder outer circumferential surface 64 of the test piece TP2, respectively.

[3] In a tensile test device, one of the arms 44 was held by a clamp 45, a tensile load was applied to the test piece TP2 by the other arm 44 such that liner wall 52 and the cylinder wall 63 were exfoliated in a direction perpendicular to the liner inner circumferential surface 53 (the cylinder outer circumferential surface 64), or along a direction of an arrow Z). Through the tensile test, the strength at which the liner wall 52 and the cylinder wall 63 were exfoliated was obtained as the bonding strength P.

[f] Voidage

Figure 10:
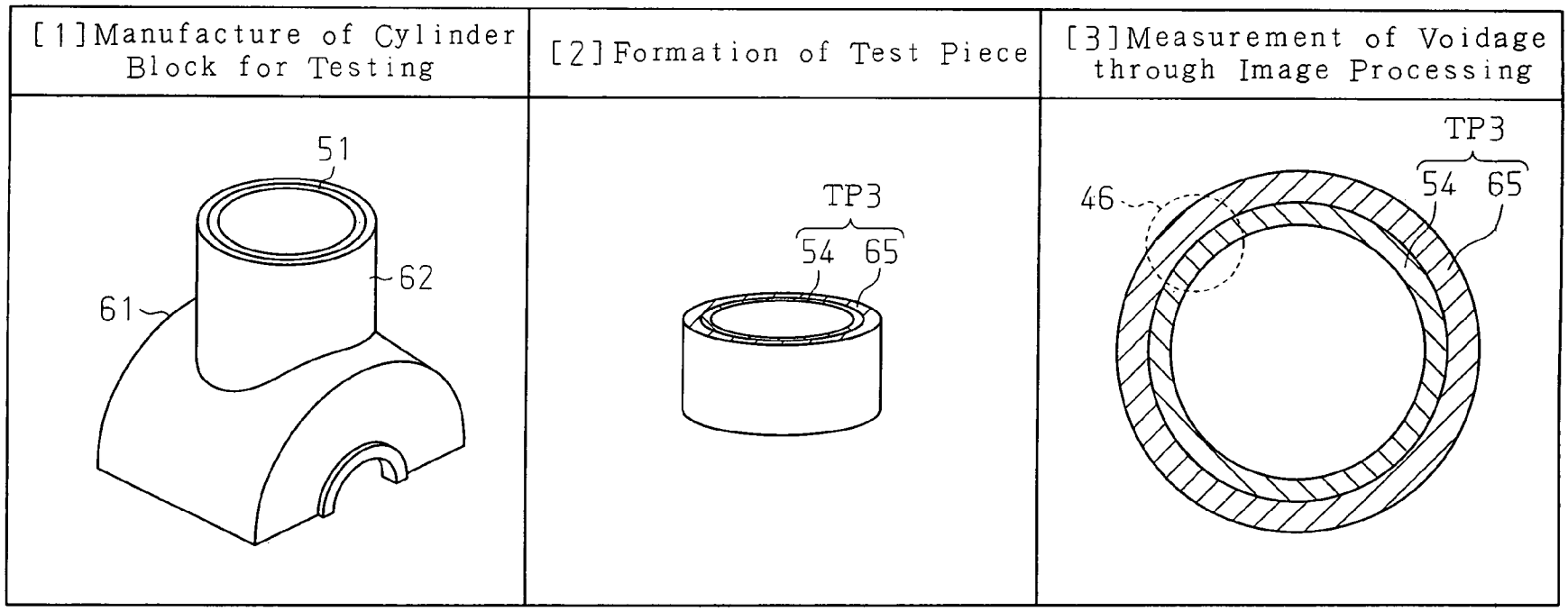
FIG. 10 is a diagram showing measurement of voidage.

FIG. 10 shows the measurement of the voidage G.

[1] Single cylinder type cylinder blocks 61 for evaluation were produced through die casting. The examples 1 to 4 and the comparison examples 1 to 4 were applied to the cylinder liners 51 for the cylinder blocks 61. The die casting was performed with the conditions shown in FIG. 9.

[2] The cylinder 62 of the single cylinder type cylinder block 61 was sliced into a ring of 15 mm thickness to form a test piece TP3 having a liner portion 54 and a cylinder portion 65.

[3] The boundary between the liner portion 54 and the cylinder portion 65 was observed with a microscope 46. Then, the voidage G was calculated through image processing of the cross-sectional photograph of the boundary.

Figure 11:
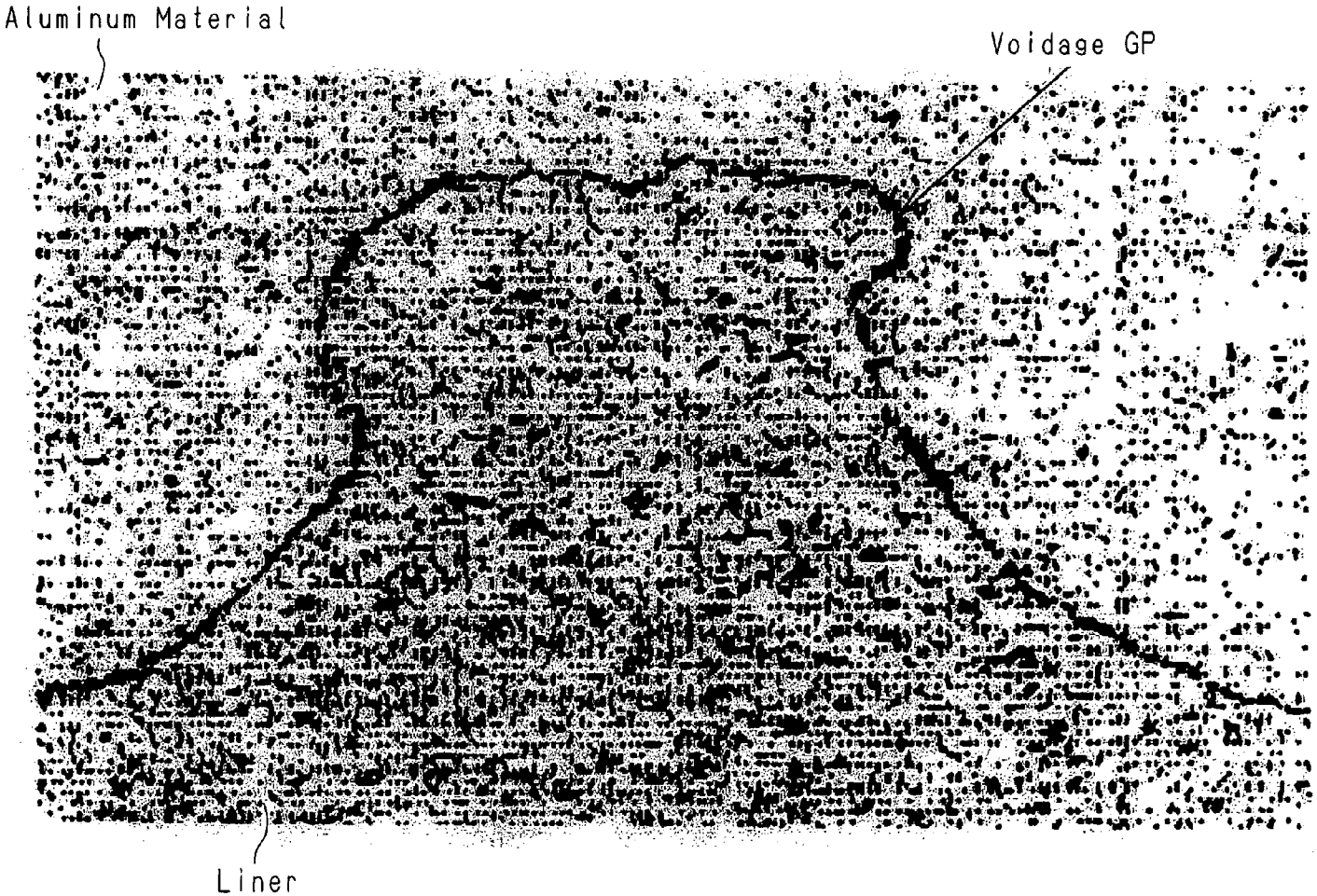
FIG. 11 is a diagram showing a photograph of a cross-section of a boundary between an aluminum material and a cylinder liner.

FIG. 11 shows one example of a photograph of the boundary between the liner portion and the cylinder portion in a test piece of a single cylinder type cylinder block to which the cylinder liner of one of the examples was applied.

The voidage ratio G is calculated as a ratio of the area of the voidage Gp (the voidage area GA) formed in the boundary between the liner portion and the cylinder portion (aluminum material) to a unit area SA in the boundary cross-sectional photograph.

The voidage ratio G is represented by the following equation.

$$G=GA/SA$$

The adherence between a cylinder liner and an aluminum material shows a correlation with the voidage ratio G. As the voidage ratio G is decreased, the adherence is increased.

[g] Degree of Constriction

Figure 12:
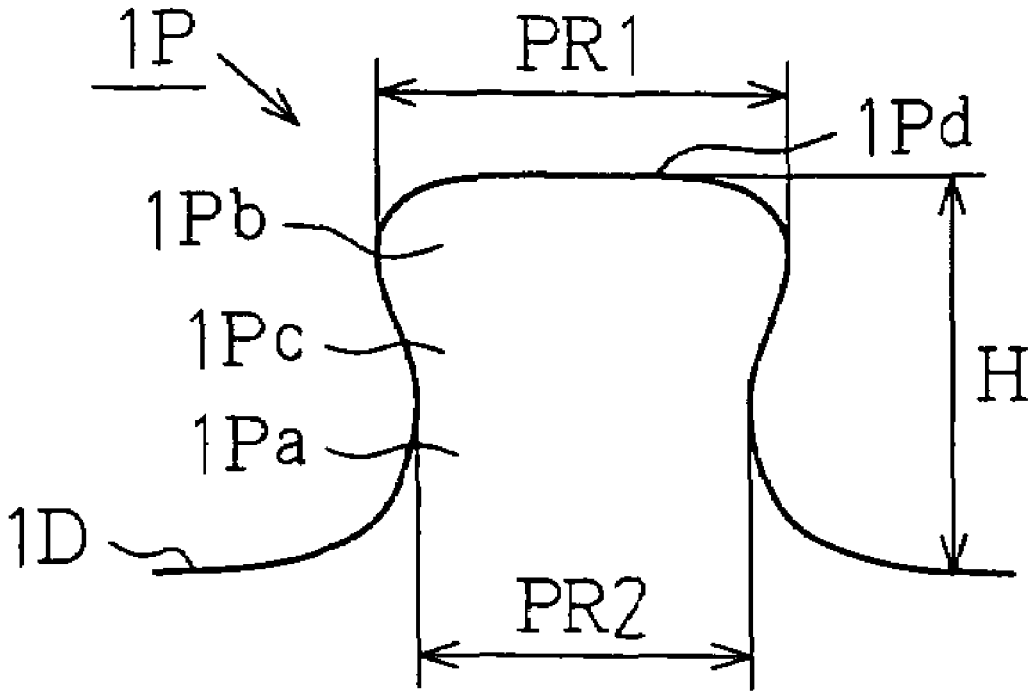
FIG. 12 is a diagram illustrating a projection with a constriction.

FIG. 12 is a diagram illustrating a model of a projection with a constriction.

The degree of constriction PR is calculated as the difference between the maximum diameter PR1 of the distal portion and the minimum diameter PR2 of the middle portion in the projection 1P, which are measured on the boundary cross-sectional photograph (FIG. 11) of the test piece TP3.

The degree of constriction PR is represented by the following equation.

$$PR=PR1-PR2 \text{ [mm]}$$

[h] Projection Height

The projection height H (the distance from the base surface 1D to the top surface 1Pd of the projection 1P) was measured with a dial depth gauge. In this embodiment, measurement was taken at four different locations for each projection 1P, and the average of the measured values was obtained as the projection height H.

The measurement results of the parameters described above are shown in table 3.

TABLE 3

| | First Projection Area Ratio [%] | Second Projection Area Ratio [%] | Number of Projections [Number/$cm^2$] | Fist Projection Cross-Sectional Area [$mm^2$/number] | Bonding Strength [MPa] | Voidage [−] | Degree of Constriction [mm] | Projection Height [mm] |
|---|---|---|---|---|---|---|---|---|
| Ex. 1 | 10 | 20 | 20 | 0.5 | 16 | 0 | 0.15 | 0.6 |
| Ex. 2 | 20 | 35 | 25 | 0.6 | 25 | 0.2 | 0.32 | 0.7 |
| Ex. 3 | 30 | 45 | 50 | 0.6 | 34 | 0.3 | 0.37 | 0.9 |
| Ex. 4 | 50 | 55 | 60 | 0.83 | 52 | 0.4 | 0.42 | 1.0 |
| Comp. Ex. 1 | 2 | 10 | 3 | 0.3 | 2.5 | 0 | 0 | 0.3 |
| Comp. Ex. 2 | 25 | 72 | 30 | 0.83 | 3 | 1.4 | 0 | 0.8 |
| Comp. Ex. 3 | 0 | 1 | 0 | 0 | 2 | 0 | 0 | 0.2 |
| Comp. Ex. 4 | 42 | 70 | * | * | 40 | 1.3 | 0.15 | 1.2 |

Figure 13:
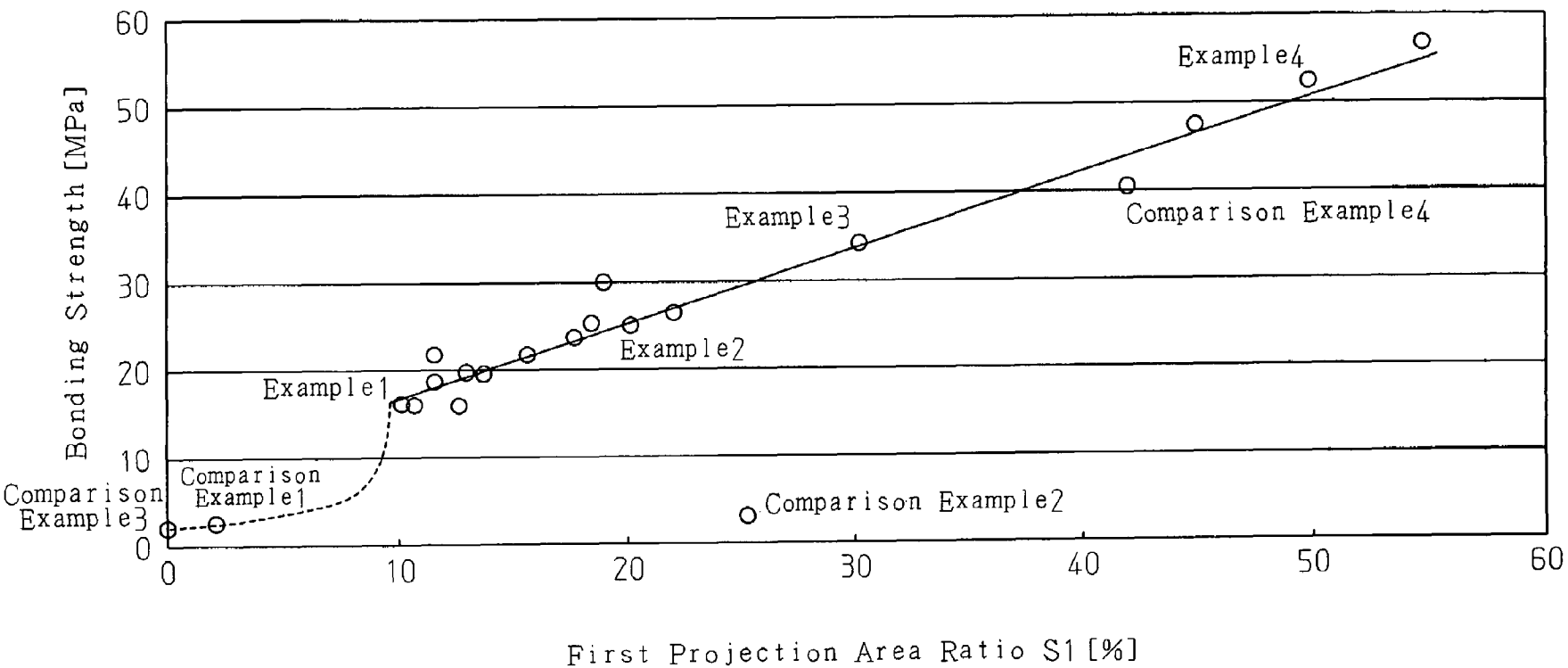
FIG. 13 is a graph showing the relationship between a first projection area ratio and bonding strength.

* means that the corresponding value cannot be measured due to projections being combined FIG. 13 shows the relationship between the first projection area ratio S1 and the bonding strength P, which were obtained through measurement.

As shown in FIG. 13, when the first projection area ratio S1 was less than 10%, the bonding strength P dropped significantly. Although the first projection area ratio S1 of the comparison example 2 was no less than 10%, the bonding strength was lower than those of the examples since the number of projections with a constriction was zero.

A cylinder liner of which the first projection area ratio S1 was no less than 10% and a cylinder liner of which the first projection area ratio S1 was less than 10% were applied to cylinder blocks, and deformation amount of these cylinder blocks were compared. The deformation amount of the latter was confirmed to be more than three times that of the former.

Figure 14:
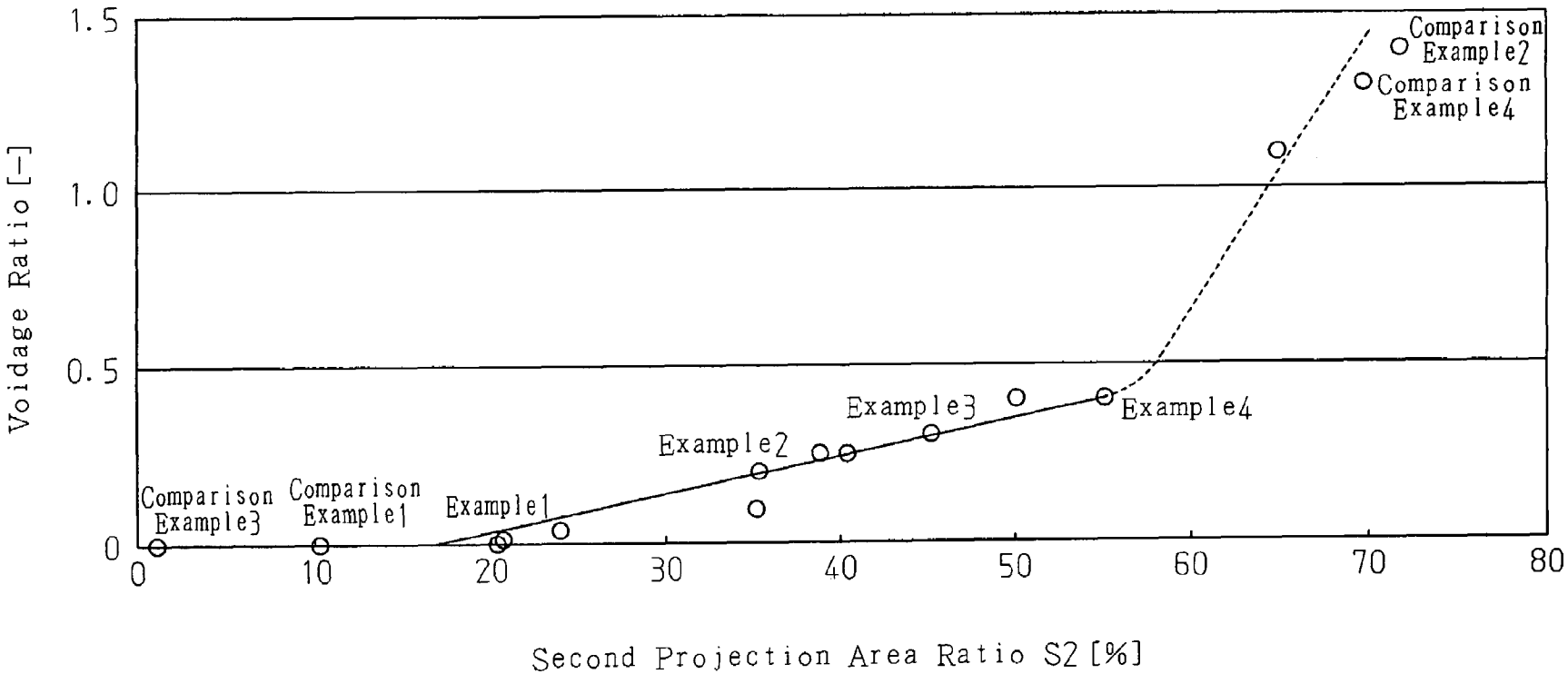
FIG. 14 is a graph showing the relationship between a second projection area ratio and voidage.

FIG. 14 shows the relationship between the second projection area ratio S2 and the voidage ratio G, which was obtained through measurement.

As shown in FIG. 14, when the second projection area ratio S2 is more than 55%, the voidage ratio G increases significantly.

From these results, it was confirmed that applying a cylinder liner of which the first projection area ratio S1 is no less than 10% and the second projection area ratio S2 is no more than 55% to a cylinder block favorably improves the bonding strength and the adherence between the block material and the cylinder liner.

By setting the upper limit of the first projection area ratio S1 to 50%, the second projection area ratio S2 is set to no more than 55%. By setting the lower limit of the second projection area ratio S2 to 20%, the first projection area ratio S1 is set no less than 10%.

Figure 15:
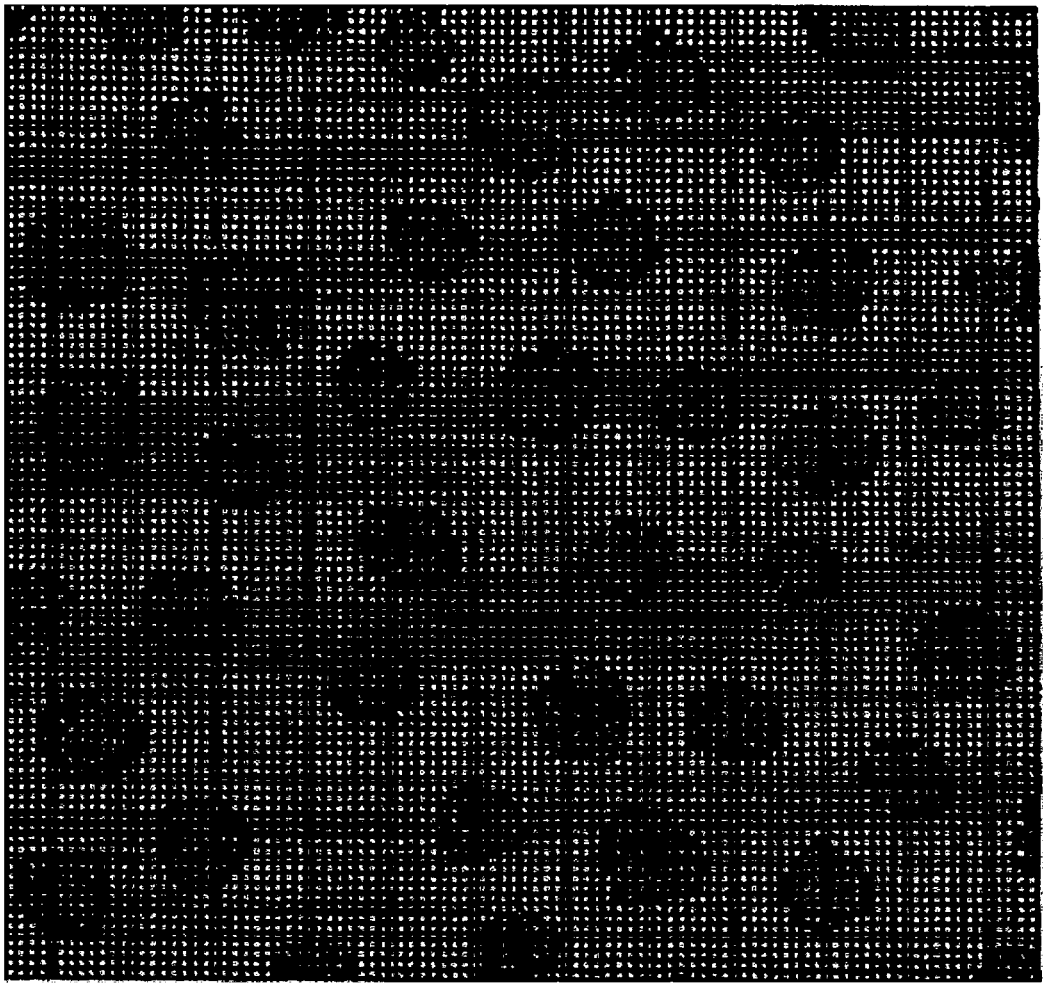
FIG. 15 is a diagram showing contour lines of a second example.

FIG. 15 is a contour diagram in which contour lines L less than 0.4 mm of measurement height are not shown in a cylinder liner of the example 2.

Figure 16:
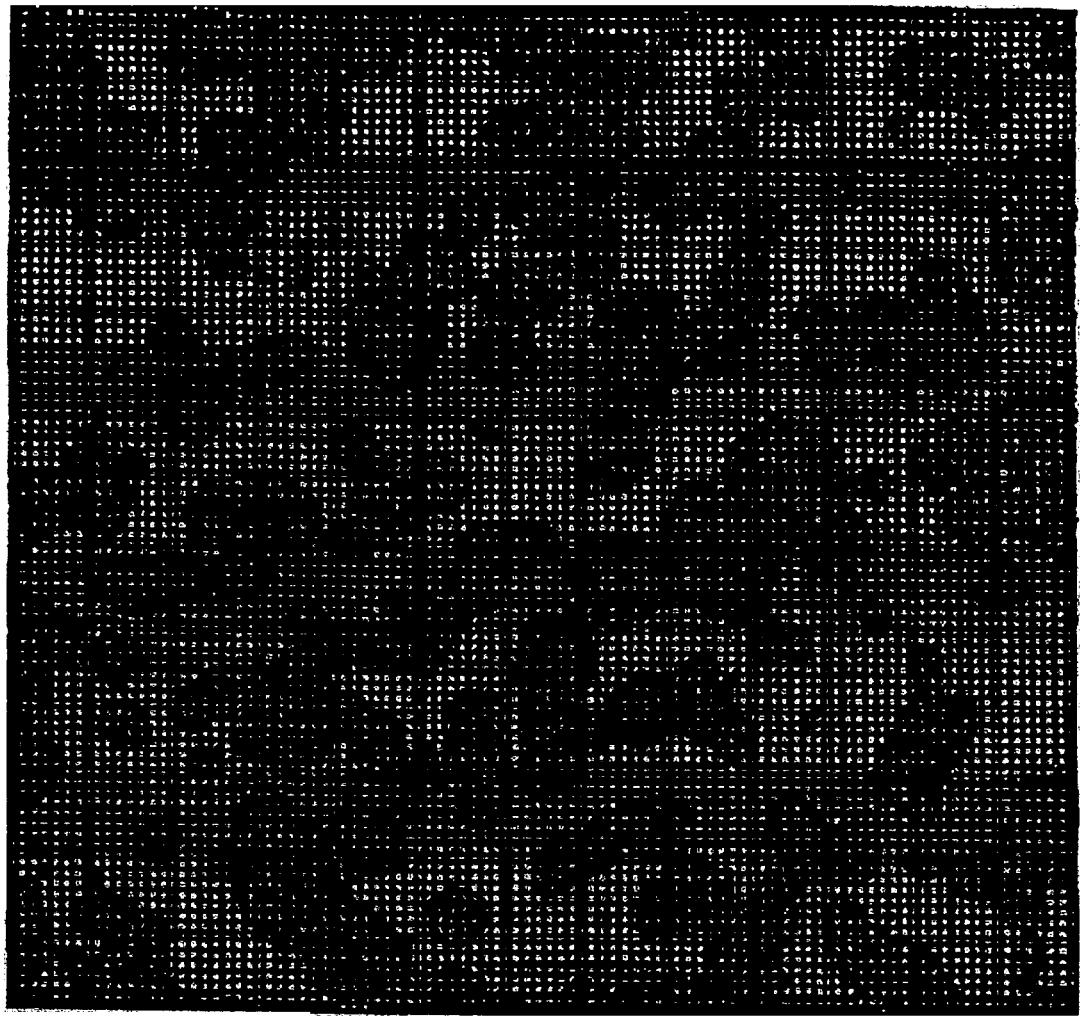
FIG. 16 is a diagram showing contour lines of a fourth comparison example.

FIG. 16 is a contour diagram in which contour lines L less than 0.4 mm of measurement height are not shown in a cylinder liner of the comparison example 4.

FIGS. 15 and 16 show that the projections of the comparison example 4 are joined together while the projections of the example 2 are independent from each other.

Advantages of Embodiment (Examples)

As described above, the cylinder liner for insert casting according to the embodiment (examples) has the following advantages.

(1) The projection height H of the cylinder liner 1 according to the embodiment is set in a range between 0.5 mm and 1.0 mm, inclusive. This configuration eliminates the following drawbacks.

If a cylinder liner is produced with the projection height H set less than 0.5 mm, a cylinder block in which the cylinder liner is provided through insert casting will not have sufficient bonding strength between the block material and the cylinder liner.

In a case where the projection height H is more than 1.0 mm, the formed projections are easily broken. This results in uneven heights among the projections and degrades the accuracy of the outer diameter. Also, since the projections on the outer circumferential surface are easily broken, the advantage of preventing the cylinder liner from falling off the block material is reduced.

(2) The number of the projections 1P per $cm^2$ on the liner outer circumferential surface 11 of the cylinder liner 1 according to the embodiment is set in a range between 5 and 60, inclusive. This configuration eliminates the following drawbacks.

A cylinder liner that has less than five projections per $cm^2$ cannot have sufficient bonding strength between the block material and the cylinder liner due to an insufficient number of projections.

In a case of a cylinder liner having more than sixty projections per $cm^2$, since the space between the projections is narrow, the filling factor of molten metal for the block material is lowered. As a result, the adherence between the block material and the cylinder liner is lowered.

(3) The first projection area ratio S1 of the cylinder liner 1 according to the embodiment is set no less than 10%. This configuration favorably increases the bonding strength between the block material and the cylinder liner.

(4) The second projection area ratio S2 of the cylinder liner 1 according to the embodiment is set to no more than 55%. This configuration favorably increases the adherence between the block material and the cylinder liner.

(5) The upper limit of the first projection area ratio S1 of the cylinder liner 1 according to the embodiment is set to 50%. This prevents the second projection area ratio S2 from surpassing 55%.

(6) The lower limit of the second projection area ratio S2 of the cylinder liner 1 according to the embodiment is set to 20%. This prevents the first projection area ratio S1 from falling below 10%.

(7) The projections 1P of the cylinder liner 1 according to the embodiment are formed such that the regions R4 each surrounded by the contour line L4 on the contour diagram are separated from each other. That is, the cylinder liner 1 is produced such that the projections 1P are independent from each other in a plane of a measurement height of 0.4 mm. This configuration favorably increases the adherence between the block material and the cylinder liner. In a cylinder liner in which a region R4 surrounded by a contour line L4 interferes another region R4, the filling factor of the block material is lowered, and spaces are created between the block material and the cylinder liner. This lowers the adherence.

(8) In a plane of a measurement height of 0.4 mm, the area of each projection is set in a range between 0.2 $mm^2$ and 3.0 $mm^2$, inclusive in the cylinder liner 1 according to the embodiment. This configuration eliminates the following drawbacks.

If the area of each projection is less than 0.2 $mm^2$, the projections have decreased strength. Therefore, when a cylinder liner having such projections is produced, the projections are damaged.

If the area of each projection is more than 3.0 $mm^2$, the adherence between the block material and the cylinder liner is lowered.

As described above, the method for manufacturing a cylinder liner for insert casting according to the embodiment (examples) has the following advantages.

(9) In the method for manufacturing a cylinder liner according to the embodiment, the loading of the refractory material C1 is set in a range between 8% by mass and 30% by mass, inclusive. This configuration eliminates the following drawbacks.

In a manufacturing method in which the loading of the refractory material C1 is less than 8% by mass, the effects of exfoliation and heat insulation of the mold wash C6 are reduced. This causes molten metal CI to be welded to the mold and degrades the material of the cylinder liner.

In a manufacturing method in which the loading of the refractory material C1 is more than 30% by mass, the fluidity of the mold wash C6 is lowered, and it is difficult to uniformly apply the mold wash C6 to the inner circumferential surface 31F of the mold 31. This lowers the accuracy of the outer diameter of the cylinder liner.

(10) In the method for manufacturing the cylinder liner according to the embodiment, the loading of the binder C2 is set in a range between 2% by mass and 10% by mass, inclusive. This configuration eliminates the following drawbacks.

In a manufacturing method in which the loading of the binder C2 is less than 2% by mass, the strength of the mold wash C6 is not sufficient. This lowers the formability of the projections 1P.

In a manufacturing method in which the loading of the binder C2 is more than 10% by mass, the fluidity of the mold wash C6 is lowered, and it is difficult to uniformly apply the mold wash C6 to the inner circumferential surface 31F of the mold 31. This lowers the accuracy of the outer diameter of the cylinder liner.

(11) In the method for manufacturing the cylinder liner according to the embodiment, the loading of water C3 is set in a range between 60% by mass and 90% by mass, inclusive. This configuration eliminates the following drawbacks.

In a manufacturing method in which the loading of water C3 is less than 60% by mass, the fluidity of the mold wash C6 is lowered, and it is difficult to uniformly apply the mold wash C6 to the inner circumferential surface 31F of the mold 31. This lowers the accuracy of the outer diameter of the cylinder liner.

In a manufacturing method in which the loading of water C3 is more than 90% by mass, the mold wash layer C7 resists being dried. This lowers the formability of the projections on the liner outer circumferential surface 11.

(12) In the method for manufacturing the cylinder liner according to the embodiment, the loading of the surfactant C5 is set in a range between 0.005% by mass and 0.1% by mass, inclusive. This configuration eliminates the following drawbacks.

In a method in which the loading of the surfactant C5 is no more than 0.005% by mass, the action of the surfactant C5 is significantly small. Thus, it is difficult to form projections on the outer circumferential surface of the cylinder liner.

In a method in which the loading of the surfactant C % is more than 0.1% by mass, the action of the surfactant C5 was excessive. Thus, it is difficult to form projections with constrictions on the outer circumferential surface of the cylinder liner.

(13) In the method for manufacturing the cylinder liner according to the embodiment, the average particle size of the refractory material C1 is set in a range between 0.02 mm and 0.1 mm, inclusive. This configuration eliminates the following drawbacks.

In a manufacturing method in which the average particle size of the refractory material C1 is less than 0.02 mm, the refractory material C1 becomes insoluble to water, which lowers the work efficiency.

In a manufacturing method in which the average particle size of the refractory material C1 is more than 0.1 mm, the inner circumferential surface of the mold wash is rough, and it is difficult to smooth sections between the projections on the liner outer circumferential surface. This lowers the filling factor of the bock material.

That is, setting the average particle size in a range between 0.02 mm and 0.1 mm improves the work efficiency for manufacturing the cylinder liner. Also, the base surface 1D is made smooth between the projections on the outer circumferential surface of the cylinder liner.

(14) In the method for manufacturing the cylinder liner according to the embodiment, the thickness of the mold wash layer C7 is set in a range between 0.5 mm and 1.1 mm, inclusive. Therefore, the projections 1P is reliably formed in a range between 0.5 mm and 1.0 mm.

<Modification>

The above illustrated embodiment may be modified as shown below.

In the illustrated embodiment, the first projection area ratio S1 is no less than 10%, and the second projection area ratio S2 is no more than 55%. These ranges of the area ratios S1, S2 may be modified as shown below.

First projection area ratio S1: 10%-30%

Second projection area ratio S2: 20%-45%

These configurations further improve the adherence and the bonding strength between the block material and the cylinder liner.

The invention claimed is:

1. A cylinder liner for insert casting, having a plurality of projections each having a constriction on an outer circumferential surface, wherein the cylinder liner satisfies the following requirements (i) to (iv):

(i) the height of projections is in a range between 0.5 mm and 1.0 mm, inclusive;

(ii) the number of the projections is in a range between 5 and 60, inclusive, per $cm^2$ on the outer circumferential surface;

(iii) a ratio S1 of area of a region that is encircled by a contour line of a height of 0.4 nim is no less than 10% in a contour diagram of the projections, the diagram being obtained through measurement of the outer circumferential surface along the height direction of the projections with a three-dimensional laser measuring device; and (iv) a ratio S2 of area of a region that is encircled by a contour line of a height of 0.2 mm is no more than 55% in a contour diagram of the projections, the diagram being obtained through measurement of the outer circumferential surface along the height direction of the projections with a three-dimensional laser measuring device.

2. The cylinder liner for insert casing according to claim 1, wherein regions each encircled by a contour line of the height of 0.4 mm are independent from each other in the contour diagram, and the area of regions each encircled by a contour line of the height of 0.4 mm is in a range between 0.2 $mm^2$ and 3.0 $mm^2$, inclusive.

3. A cylinder liner for insert casting, having a plurality of projections each with a constriction on an outer circumferential surface, wherein the cylinder liner satisfies the following requirements (i) to (iv):

(i) the height of projections is in a range between 0.5 mm and 1.0 mm, inclusive;

(ii) the number of the projections is in a range between 5 and 60, inclusive, per $cm^2$ on the outer circumferential surface;

(iii) a ratio S1 of area of a region that is encircled by a contour line of a height of 0.4 mm is in a range between 10% and 50%, inclusive, in a contour diagram of the projections, the diagram being obtained through measurement of the outer circumferential surface along the height direction of the projections with a three-dimensional laser measuring device; and (iv) a ratio S2 of area of a region that is encircled by a contour line of a height of 0.2 mm is in a range between 20% and 55%, inclusive, in a contour diagram of the projections, the diagram being obtained through measurement of the outer circumferential surface along the height direction of the projections with a three-dimensional laser measuring device.

4. The cylinder liner for insert casing according to claim 3, wherein regions each encircled by a contour line of the height of 0.4 mm are independent from each other in the contour diagram, and the area of regions each encircled by a contour line of the height of 0.4 mm is in a range between 0.2 $mm^2$ and 3.0 $mm^2$, inclusive.

* * * * *

UNITED STATES PATENT AND TRADEMARK OFFICE

CERTIFICATE OF CORRECTION

PATENT NO. : 7,383,805 B2
APPLICATION NO. : 10/585583
DATED : June 10, 2008
INVENTOR(S) : Hirofumi Michioka et al.

It is certified that error appears in the above-identified patent and that said Letters Patent is hereby corrected as shown below:

| Column | Line | |
|---|---|---|
| 2 | 65 | Change “does” to --do--. |
| 4 | 15 | Change “does” to --do--. |
| 9 | 10 | Change “was layer” to --wash layer--. |
| 16 | 29 | After “interferes” insert --with--. |
| 17 | 39 | Change “surfactant C %” to --surfactant C**5**--. |
| 18 | 26 | Change “0.4 nim” to --0.4mm--. |
| 18 | 39 | Change “insert casing” to --insert casting--. |
| 19 | 1 | Change “insert casing” to --insert casting--. |

Signed and Sealed this

Twelfth Day of May, 2009

John Doll

JOHN DOLL
*Acting Director of the United States Patent and Trademark Office*